US005638954A

United States Patent [19]

Hsien

[11] Patent Number: 5,638,954

[45] Date of Patent: Jun. 17, 1997

[54] DETACHABLE FRAME MOUNTING STRUCTURE FOR GOLF BAGS

[76] Inventor: Chi-Chung Hsien, 6F-3, No. 67, Sung Chiang Road, Taipei, Taiwan

[21] Appl. No.: 523,644

[22] Filed: Sep. 5, 1995

[51] Int. Cl.[6] ..... A63B 55/00

[52] U.S. Cl. ..... 206/315.8; 206/315.3; 206/315.7

[58] Field of Search ..... 206/315.3, 315.6, 206/315.7, 315.8

[56] References Cited

U.S. PATENT DOCUMENTS

| | | | |
|---|---|---|---|
| 1,826,216 | 10/1931 | Johnson | 206/315.6 |
| 1,951,158 | 3/1934 | Locke et al. | 206/315.6 X |
| 2,435,479 | 2/1948 | Thommen | 206/315.8 |
| 2,855,967 | 10/1958 | Wycherley | 206/315.8 |
| 3,674,072 | 7/1972 | Shuto | 206/315.6 |
| 4,181,167 | 1/1980 | Ret | 206/315.6 |
| 4,635,793 | 1/1987 | Kim | 206/315.6 |
| 4,865,192 | 9/1989 | Williams | 206/315.7 |
| 4,967,904 | 11/1990 | Quellais et al. | 206/315.3 |
| 5,178,273 | 1/1993 | Igarashi | 206/315.7 |
| 5,361,899 | 11/1994 | Reimers | 206/315.6 |

FOREIGN PATENT DOCUMENTS

| | | | |
|---|---|---|---|
| 191589 | 1/1923 | United Kingdom | 206/315.6 |
| 205431 | 10/1923 | United Kingdom | 206/315.6 |
| 398212 | 8/1933 | United Kingdom | 206/315.6 |
| 473388 | 10/1937 | United Kingdom | 206/315.7 |

*Primary Examiner*—Sue A. Weaver
*Attorney, Agent, or Firm*—Morton J. Rosenberg; David I. Klein

[57] ABSTRACT

A detachable frame mounting structure for golf bags includes an upper frame at an upper end of the golf bag for insertion therethrough a golf club into the golf bag, a plurality of support holes being provided at suitable positions at a periphery of a bottom portion of the upper frame, and a lower frame at a lower end of the golf bag for supporting the golf club, a plurality of adjustment screw posts corresponding to the support holes of the upper frame in number being provided at a periphery of an inner side of the lower frame.

A plurality of hollow support rods are severally inserted with their top ends into the support holes of the upper frame. A plurality of adjustment screw elements having shanks are driven into the adjustment screw posts such that the shanks fit into the bottom holes of the hollow support rods. By means of adjusting the adjustment screw elements inside the adjustment screw posts upwardly or downwardly, the support rods may be caused to stretch upwardly to force a golf bag jacket to become taut.

3 Claims, 5 Drawing Sheets

DETACHABLE FRAME MOUNTING STRUCTURE FOR GOLF BAGS

BACKGROUND OF THE INVENTION

Existing mounting structures for golf bags are generally fixed and cannot be dismantled. Golf bags are bulky and occupy considerable space, hence they are inconvenient to carry or store. Owing to their size, they will take up almost the entire space of the car's trunk where they are usually put.

SUMMARY OF THE INVENTION

A primary object of the present invention is to provide a frame mounting structure for golf bags, which may be easily dismantled, convenient to carry, and space-saving.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
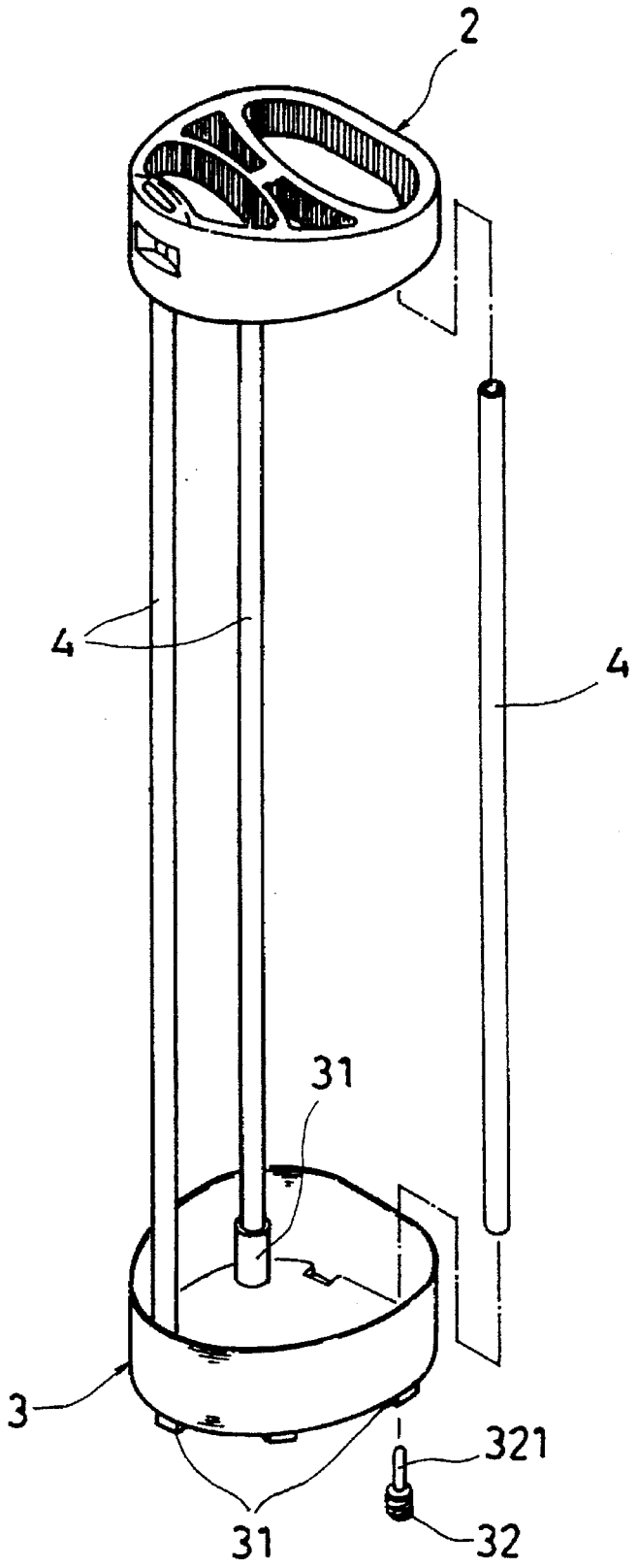
FIG. 1 is a perspective exploded view of a first preferred embodiment of the frame mounting structure according to the present invention.
Figure 2:
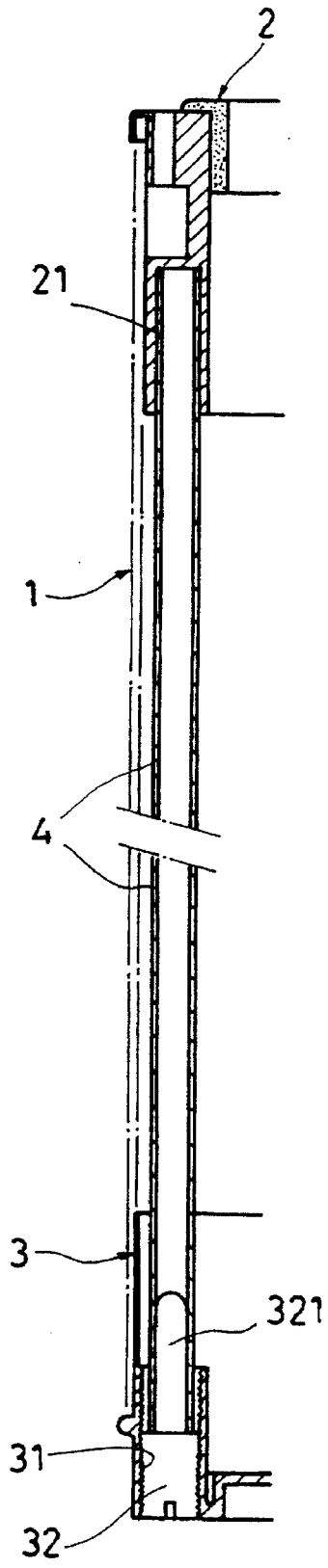
FIG. 2 is a detailed sectional view of the frame mounting structure of the present invention viewed from the side.
Figure 3:
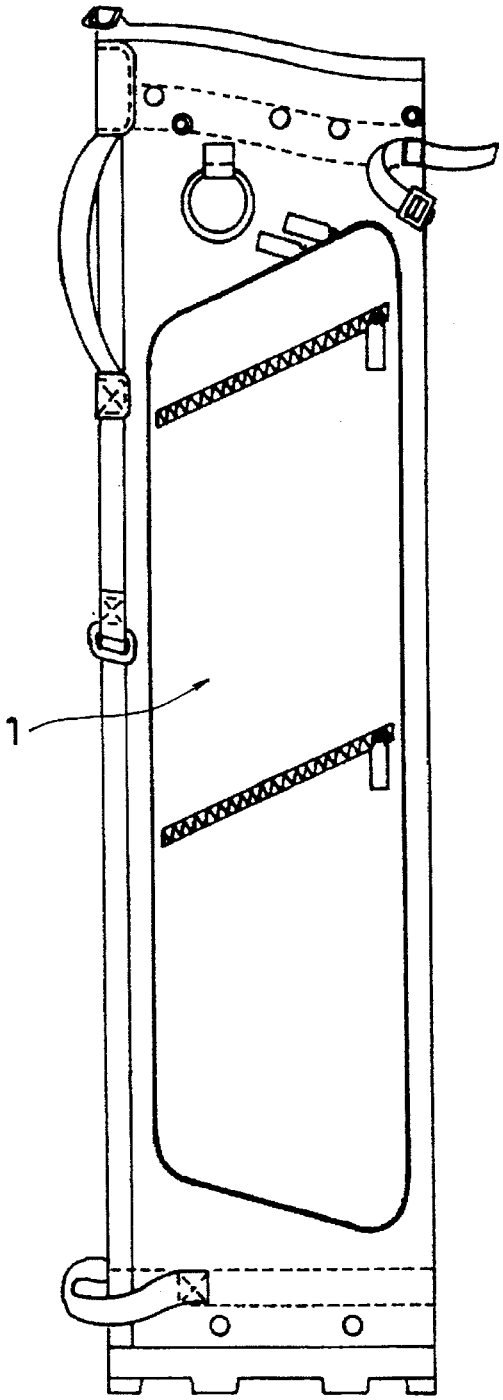
FIG. 3 is an outer side view of the present invention.
Figure 4:
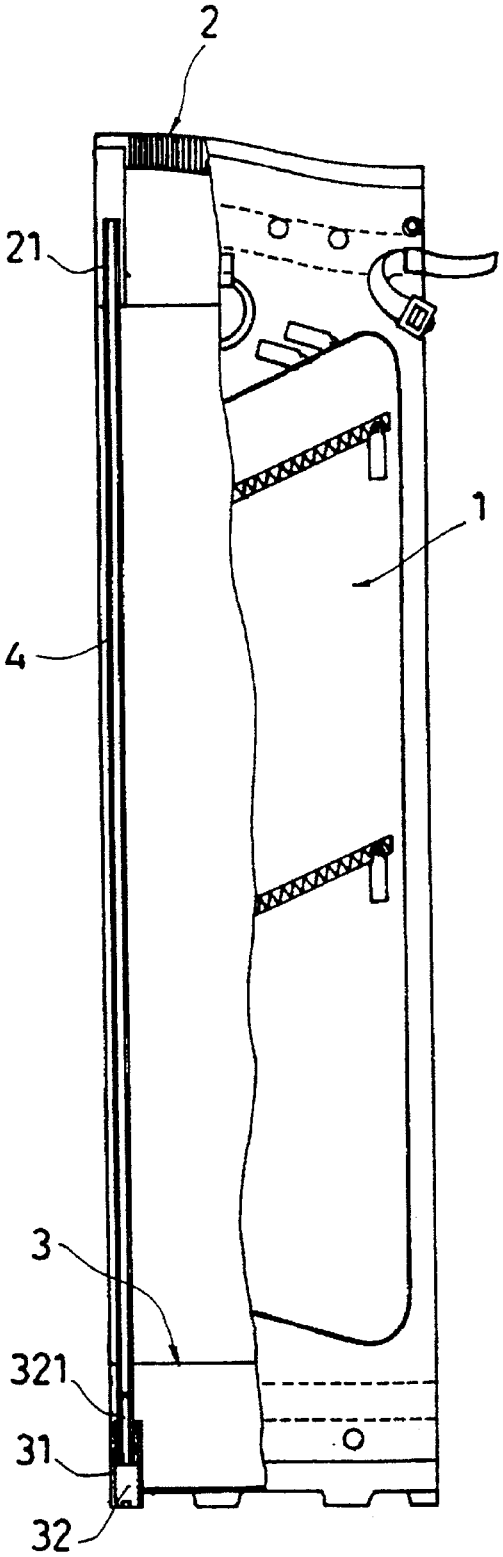
FIG. 4 is a sectional view of the frame mounting structure of the present invention in part.

With reference to FIGS. 1–4, the present invention comprises a golf bag 1 with an upper end thereof provided with an upper frame 2 for insertion therethrough a golf club into the golf bag 1. A plurality of support holes 21 are provided at suitable positions at a bottom periphery of an inner side of the upper frame 2. A lower end of the golf bag is provided with a lower frame 3 for supporting the golf club. Adjustment screw posts 31 corresponding to the support holes 21 of the upper frame in number are provided at suitable positions of a periphery of an inner side of the lower frame 3. Substantially hollow support rods 4 are individually inserted into each of the screw posts 31 of the lower frame 3 such that the top ends of these support rods 4 respectively fit into the support holes 21 of the upper frame 2. Adjustment screw elements 32 with shanks 321 are severally screwed into each of these screw posts 31 from the bottom ends thereof such that each of the shanks 321 of the adjustment screw elements 32 fits into a hole in a bottom end of each support rod 4. Besides, by adjusting the adjustment screw elements 32 within the screw posts 31 in an upward or downward manner, the support rods may be adjusted and caused to stretch upwardly so that the golf bag jacket is taut. To dismantle the golf bag according to the present invention, it is only necessary to unscrew each of the adjustment screw elements 32 and remove the support rods 4 as well as the accessories on the outside of the golf bag. The golf bag may then be folded to facilitate packaging or carrying.

Figure 5:
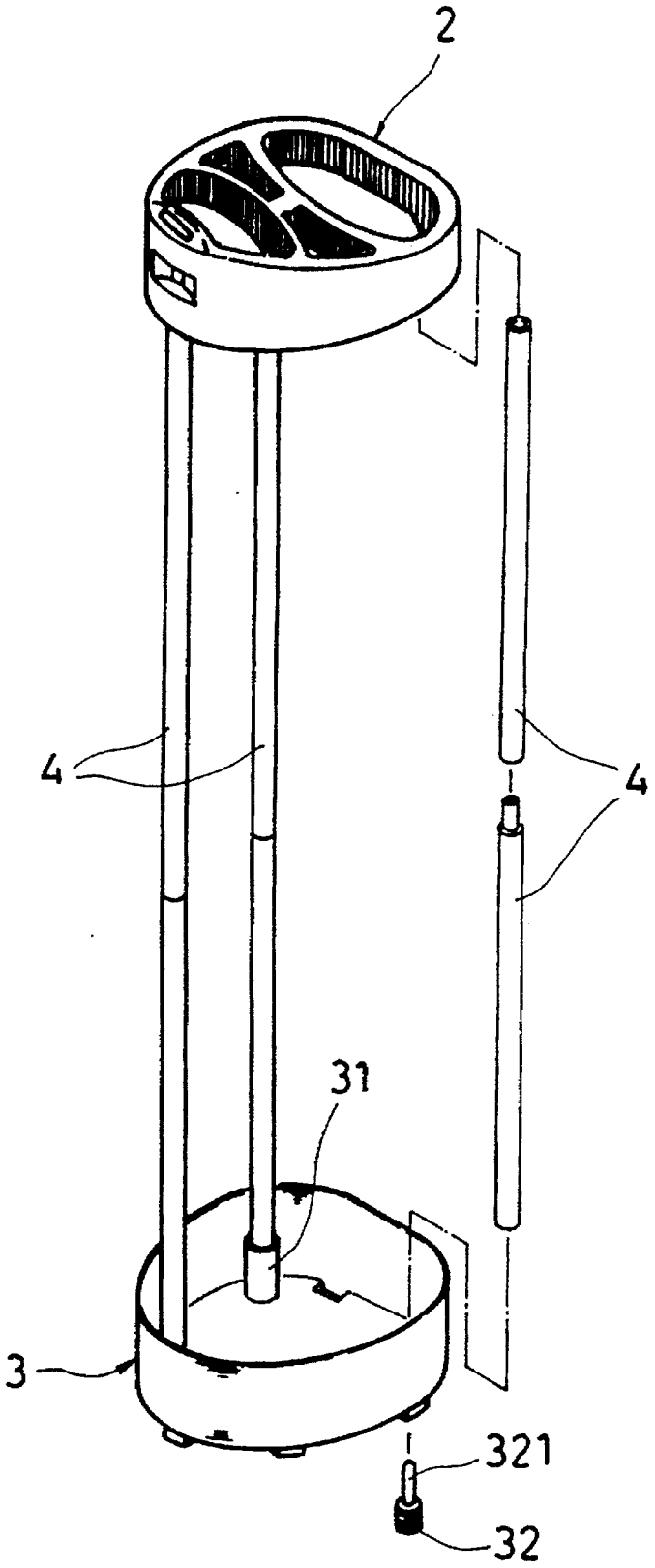
FIG. 5 is a perspective exploded view of a second preferred embodiment of the frame mounting structure according to the present invention.

FIG. 5 shows a second preferred embodiment of the present invention, in which the support rod 4 may be configured to consist of a plurality of segments. Such a configuration reduces the overall length of the support rod and facilitates carrying and storage.

Figure 6:
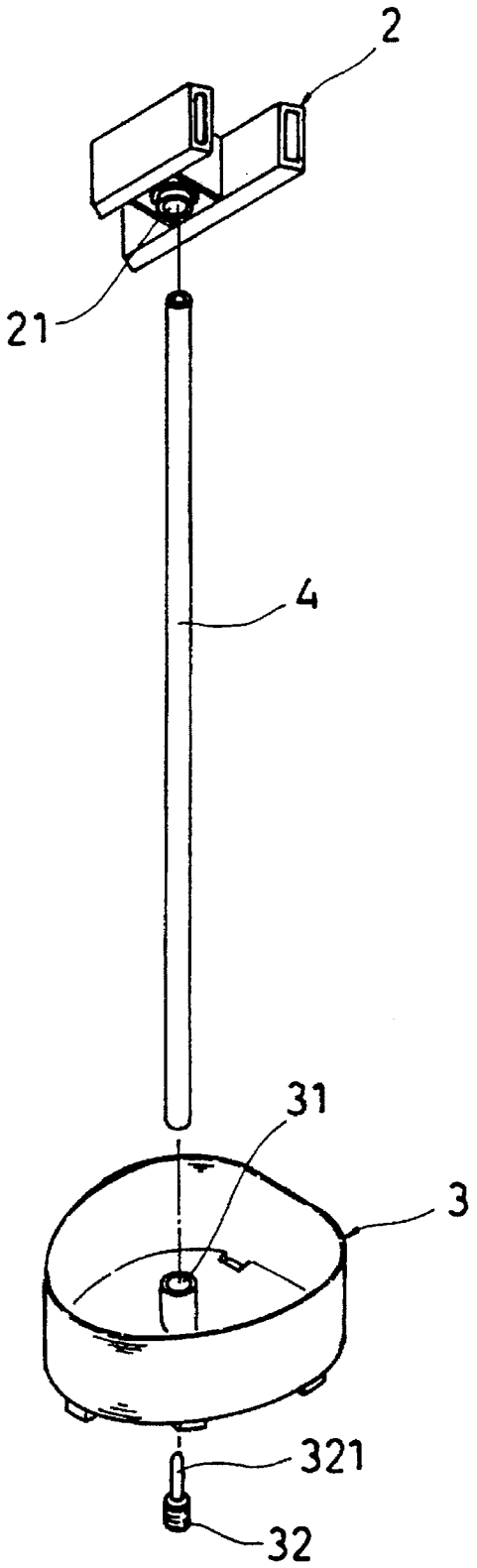
FIG. 6 is a perspective exploded view of a third preferred embodiment of the frame mounting structure according to the present invention.

FIG. 6 shows a third preferred embodiment of the present invention. An upper frame 2 is centrally provided with a support hole 21, and a lower frame 3 is also centrally provided with an adjustment screw post 31. A support rod 4 may be connected to the central portions of the upper frame 2 and the lower frame 3 to achieve equivalent tight stretching effects of the golf bag. In this preferred embodiment, the number of support rods 4 is reduced, hence the golf bag of the present invention is more convenient to keep, assemble and carry.

Although the present invention has been illustrated and described with reference to the preferred embodiment thereof, it should be understood that it is in no way limited to the details of such embodiment but is capable of numerous modifications within the scope of the appended claims.

What is claimed is:

1. A detachable frame mounting structure for golf bags, comprising:

an upper frame located at an upper end of a golf bag for insertion of a golf club therethrough into the golf bag, said upper frame being provided with a plurality of support holes at suitable positions of a periphery of a bottom portion of an inner side of said upper frame;

a lower frame located at a lower end of a golf bag for supporting the golf club, said lower frame being provided with a plurality of adjustment screw posts equivalent to said support holes of said upper frame in number, said adjustment screw posts being disposed around a periphery of said lower frame, each of said adjustment screw posts having formed therein an interiorly threaded through bore extending between an open top end and an open bottom end;

a plurality of adjustment screw elements, each of said plurality of adjustment screw elements being inserted into a respective one of said screw post through bores, each of said screw elements having an upper shank and a lower threaded portion, said lower threaded portion threadedly engaging a respective interiorly threaded screw post through bore, and said lower threaded portion being accessible through said open bottom end of said adjustment screw post for upward and downward adjustment of said screw element;

a plurality of longitudinally extended support rods removably coupled to said upper and lower frames, each of said rods having an upper rod end, a lower rod end and a longitudinally directed bore extending between said upper and lower rod ends, said upper rod being slidably engaged within a respective one of said support holes of said upper frame, said lower rod end being slidably disposed in a respective one of said screw posts of said lower frame, said upper shank of each of said screw elements extending into said longitudinal through bore of a respective support rod to provide a detachable coupling therebetween, whereby said upward and downward adjustment of said respective screw element correspondingly adjusts both a position of said support rod and a tension force exerted thereby on a golf bag jacket secured between said upper frame and said lower frame.

2. A detachable frame mounting structure for golf bags as claimed in claim 1, wherein each of said support rods includes a plurality of rod segments and means for detachably connecting said rod segments together.

3. A detachable frame mounting structure for golf bags, comprising:

an upper frame located at an upper end of a golf bag for insertion of a golf club therethrough into the golf bag, said upper frame having a centrally disposed support hole formed at a bottom side thereof;

a lower frame located at a lower end of a golf bag for supporting the golf club, said lower frame having a centrally disposed adjustment screw post formed thereon, said adjustment screw post having an interiorly threaded through bore extending between an open top end and an open bottom end of said adjustment screw post;

an adjustment screw element for threaded engagement within said screw post through bore, said screw element having an upper shank and a lower threaded portion, said lower threaded portion threadedly engaging said interiorly threaded through bore of said adjustment screw post, and said lower threaded portion being accessible through said open bottom end of said adjustment screw post for upward and downward adjustment of said screw element within said threaded through bore of said adjustment screw post;

a support rod removably coupled to said upper and lower frames, said support rod having an upper rod end, a lower rod end, and a longitudinal through bore extending between said upper and lower rod ends, said upper rod end being slidably engaged within said support hole of said upper frame, said lower rod end being slidably disposed in said screw post of said lower frame, said upper shank of said screw element extending into said longitudinal through bore of said support rod to provide a detachable coupling therebetween, whereby said upward and downward adjustment of said screw element correspondingly adjusts both a position of said support rod and a tension force exerted thereby on a golf bag jacket secured between said upper frame and said lower frame.

* * * * *

UNITED STATES PATENT AND TRADEMARK OFFICE

CERTIFICATE OF CORRECTION

PATENT NO. : 5,638,954

DATED : 17 JUNE 1997

INVENTOR(S) : CHI-CHUNG HSIEH

It is certified that error appears in the above-identified patent and that said Letters Patent are hereby corrected as shown below: On the title page: Item [76]

delete the name "Hsien" and
insert the name --Hsieh--

Signed and Sealed this

Twenty-seventh Day of April, 1999

*Attest:*

*Attesting Officer*

Q. TODD DICKINSON

*Acting Commissioner of Patents and Trademarks*